US008770135B2

(12) United States Patent
Craze et al.

(10) Patent No.: US 8,770,135 B2
(45) Date of Patent: Jul. 8, 2014

(54) CONVERTIBLE BOATS

(76) Inventors: Matthew Kingsley Craze, Devonport (AU); Andrew Charles Fearman, Launceston (AU)

( * ) Notice: Subject to any disclaimer, the term of this patent is extended or adjusted under 35 U.S.C. 154(b) by 312 days.

(21) Appl. No.: 13/145,576

(22) PCT Filed: Jan. 15, 2010

(86) PCT No.: PCT/AU2010/000037

§ 371 (c)(1),
(2), (4) Date: Aug. 31, 2011

(87) PCT Pub. No.: WO2010/083551

PCT Pub. Date: Jul. 29, 2010

(65) Prior Publication Data

US 2011/0303142 A1 Dec. 15, 2011

(30) Foreign Application Priority Data

Jan. 23, 2009 (AU) ..... 2009900272

(51) Int. Cl.
*B63B 17/00* (2006.01)

(52) U.S. Cl.
USPC ..... 114/361

(58) Field of Classification Search
USPC ..... 114/361
See application file for complete search history.

(56) References Cited

U.S. PATENT DOCUMENTS 3,179,959 A * 4/1965 McDougall ..... 114/361
3,285,258 A * 11/1966 Hage et al. ..... 114/361
3,797,436 A * 3/1974 Moore ..... 114/71
5,016,558 A * 5/1991 Oehler ..... 114/361
5,044,298 A * 9/1991 Pepper et al. ..... 114/361
5,303,667 A * 4/1994 Zirkelbach et al. ..... 114/361
6,820,917 B2 * 11/2004 Grubbs ..... 296/107.17
6,837,173 B2 * 1/2005 Eck et al. ..... 114/55.53
6,860,222 B2 * 3/2005 Himmel ..... 114/361
7,013,830 B1 * 3/2006 Willis ..... 114/361
7,178,476 B1 * 2/2007 Belkov ..... 114/361
7,270,075 B1 * 9/2007 Jones ..... 114/361

(Continued)

FOREIGN PATENT DOCUMENTS

DE 19951619 A1 4/2001
WO WO-93/04912 A1 3/1993
WO WO 9304912 * 3/1993

*Primary Examiner* — Lars A Olson
*Assistant Examiner* — Jovon Hayes
(74) *Attorney, Agent, or Firm* — Harness, Dickey & Pierce, P.L.C.

(57) ABSTRACT

A boat having opposing side walls with gunwales thereon, a foredeck between the side walls and below the gunwales, wales, an extensible and retractable windscreen in front and around the sides of the foredeck, a helm console behind the foredeck, and an erectable and collapsible hard top pivoted to the side walls of the boat, wherein the boat is selectively convertible between: a first configuration in which the windscreen is retracted below or just above the gunwales, and the hard top is collapsed forwardly to overlap the retracted windscreen and/or the gunwales to form a platform covering the foredeck; a second configuration in which the windscreen is extended above the gunwales, and the hard top is partially erected to overlap the extended windscreen, so that together the windscreen and hard top form an enclosure over, above and around the front and sides of the foredeck; and a third configuration in which the windscreen is retracted below or just above the gunwales, and the hard top is fully erected over and above the helm console.

17 Claims, 6 Drawing Sheets

(56) References Cited

U.S. PATENT DOCUMENTS

| | | | | |
|---|---|---|---|---|
| 7,373,897 | B2 * | 5/2008 | Tufte | 114/361 |
| 7,424,861 | B2 * | 9/2008 | Mercier et al. | 114/361 |
| 7,520,240 | B2 * | 4/2009 | Tufte | 114/361 |
| 2007/0186838 | A1 | 8/2007 | Mercier et al. | |
| 2011/0303142 | A1 * | 12/2011 | Craze et al. | 114/361 |

* cited by examiner

CONVERTIBLE BOATS

CROSS-REFERENCE TO RELATED APPLICATIONS

This application is a 371 U.S. National Stage of International Application No. PCT/AU2010/000037, filed Jan. 15, 2010, and claims priority to Australian patent application No. 2009900272 filed Jan. 23, 2009, the disclosures of which are herein incorporated by reference in their entirety.

FIELD OF THE INVENTION

The present invention relates to convertible boats.

BACKGROUND OF THE INVENTION

Boats are conventionally configured with covered areas for specific applications. For example, fishing boats have open decks with covered helm consoles, passenger boats have covered cockpits and cabins, and work boats have covered deck areas for stowing supplies and equipment thereon and thereunder. Once a boat is purchased for a specific application, its covered area layout is largely set by that application. Only minor changes to the boat's layout of covered area are generally possible after the boat has been fabricated, for example, by deploying temporary canopies or covers over uncovered areas.

What is needed is a boat having covered areas that are convertible for different applications.

SUMMARY OF THE INVENTION

According to the present invention, there is provided a boat having opposing side walls with gunwales thereon, a foredeck between the side walls and below the gunwales, an extensible and retractable windscreen in front and around the sides of the foredeck, a helm console behind the foredeck, and an erectable and collapsible hard top pivoted to the side walls of the boat, wherein the boat is selectively convertible between:

- a first configuration in which the windscreen is retracted below or just above the gunwales, and the hard top is collapsed forwardly to overlap the retracted windscreen and/or the gunwales to form a platform covering the foredeck;
- a second configuration in which the windscreen is extended above the gunwales, and the hard top is partially erected to overlap the extended windscreen, so that together the windscreen and hard top form an enclosure over, above and around the front and sides of the foredeck; and
- a third configuration in which the windscreen is retracted below or just above the gunwales, and the hard top is fully erected over and above the helm console.

The hard top can be pivoted to each side wall by one or two dual hinged arms.

The windscreen can be slidably mounted to each side wall on linear tracks.

The hard top and windscreen can each be controllably actuatable between selected positions by one or more actuators.

The foredeck can include a seating area.

The helm console can be a centre console.

The present invention also provides a hard top for a boat having opposing side walls with gunwales thereon, a foredeck between the side walls and below the gunwales, and a helm console behind the foredeck, wherein the hard top is pivotally attachable to the side walls of the boat via dual hinged arms so that in use the hard top is erectable and collapsible between:

- a first configuration in which the hard top is collapsed forwardly to overlap the gunwales to form a platform covering the foredeck;
- a second configuration in which the hard top is partially erected to form a cover over and above the foredeck; and
- a third configuration in which the hard top is fully erected over and above the helm console.

The present invention further provides a method of selectively covering different areas of a boat having opposing side walls with gunwales thereon, a foredeck between the side walls and below the gunwales, and a helm console behind the foredeck, the method including the steps of:

- pivoting an erectable and collapsible hard top to the side walls of the boat;
- collapsing the hard top forwardly to overlap the gunwales to form a platform covering the foredeck;
- partially erecting the hard top to form a cover over and above the foredeck;
- fully erecting the hard top over and above the helm console.

BRIEF DESCRIPTION OF THE DRAWINGS

The invention will be further described by way of example only with reference to the accompanying drawings, in which.

DETAILED DESCRIPTION

Figure 1:
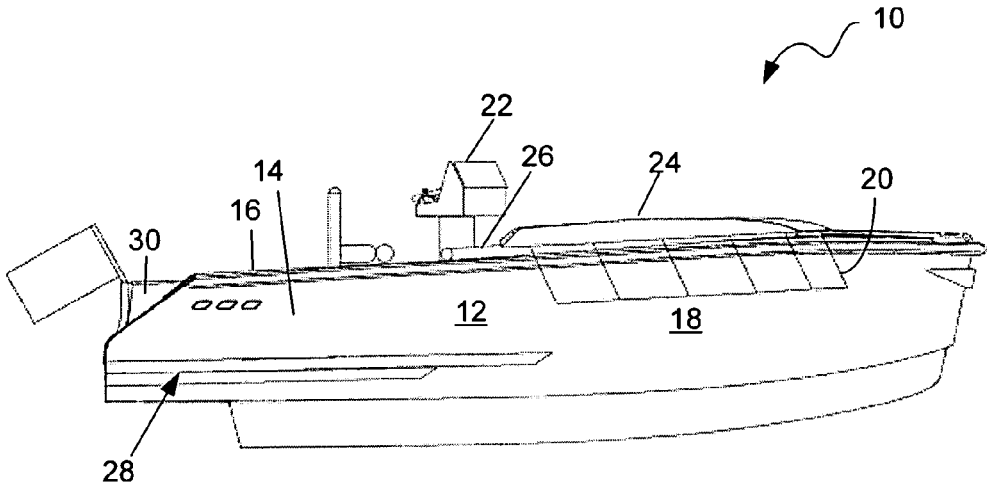
FIGS. 1 to 3 are side views of an embodiment of a convertible boat of the invention in three different configurations of covered areas.

An embodiment of a boat 10 of the invention is illustrated in FIGS. 1 to 8. The boat 10 has a hull 12 with opposing side walls 14 with gunwales 16 thereon. A foredeck 18, for example a forward seating area, is provided between the side walls 14 and below the gunwales 16. An extensible and retractable windscreen 20 is provided in front and around the sides of the foredeck 18. The windscreen 20 is slidably mounted to the side walls 14 by linear tracks (not shown). The windscreen 20 is, for example, a one-piece wrap-around windscreen. Other equivalent multi-piece windscreens may also be used, for example, separate front and side windscreens.

A helm console 22, for example, a centre helm console, is provided behind the forward seating area 18. An erectable and collapsible hard top 24 is pivoted to the side walls 14 by, for example, two pairs of dual hinged arms 26. Each arm 26 is hinged at its upper end to the side of the hard top 24, and hinged at its lower end to an upper portion of a side wall 14. Other equivalent pivotal linkages may also be used. The boat 10 further includes an aft deck 28 between the side walls 14 and below the gunwales 16 with a pair of extensible and retractable stern doors 30. Other stem configurations, for example one or more vertically pivoted transom doors, may also be used depending on whether inboard or outboard motors are used. The windscreen 20, hard top 24 and stern doors 30 are controllably actuatable between selected positions by actuators (not shown). The windscreen 20 is retractable below or just above the gunwales 16 along linear tracks (not shown). The windscreen 20 and/or the stem doors 30 are retractable, for example, into cavities in the gunwales 16, or into overlying relationship with inner surfaces of the side walls 14.

Figure 4:
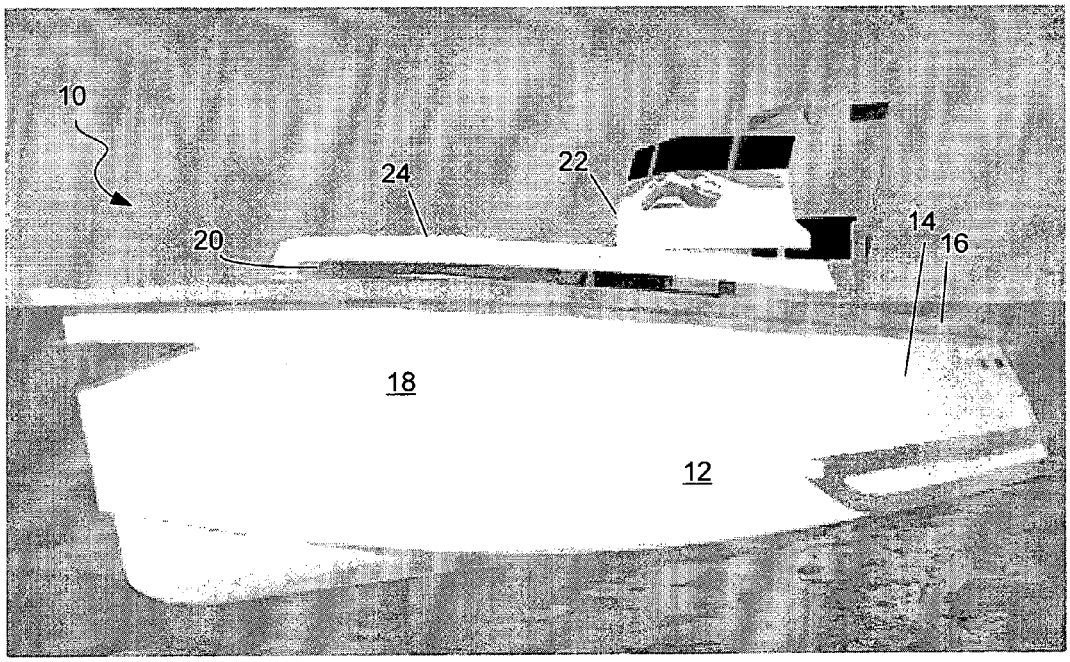
FIGS. 4 to 6 are perspective side views of the convertible boat in the three different covered area configurations.

In use, the covered areas of the boat 10 are selectively convertible between different configurations for different applications. FIGS. 1 and 4 illustrate the boat 10 in a first configuration, for example a "work" configuration, in which the windscreen 20 is retracted is retracted below or just above the gunwales 16, and the hard top 24 is collapsed forwardly to overlap the retracted windscreen 20 and/or the gunwales 16 to form a platform sealingly covering the foredeck 18. In this configuration the hard top 24 seals off the foredeck 18 keeping it clean and dry during transit to the dockside or shore to collect passengers. It also provides a sturdy platform over and above the foredeck 18 to transport garbage, supplies and equipment thereon while keeping the foredeck 18 clean. In this collapsed configuration, the swing-over hard top 24 also advantageously allows, for example, large trailer versions of the boat 10 to be stored in a low car port and towed behind a vehicle with reduced drag, and hence with improved fuel efficiency.

Figure 2:
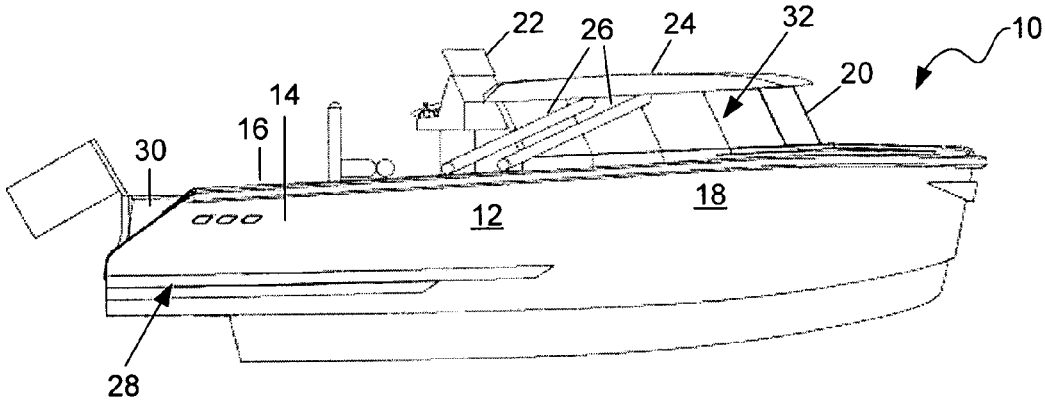
Figure 5:
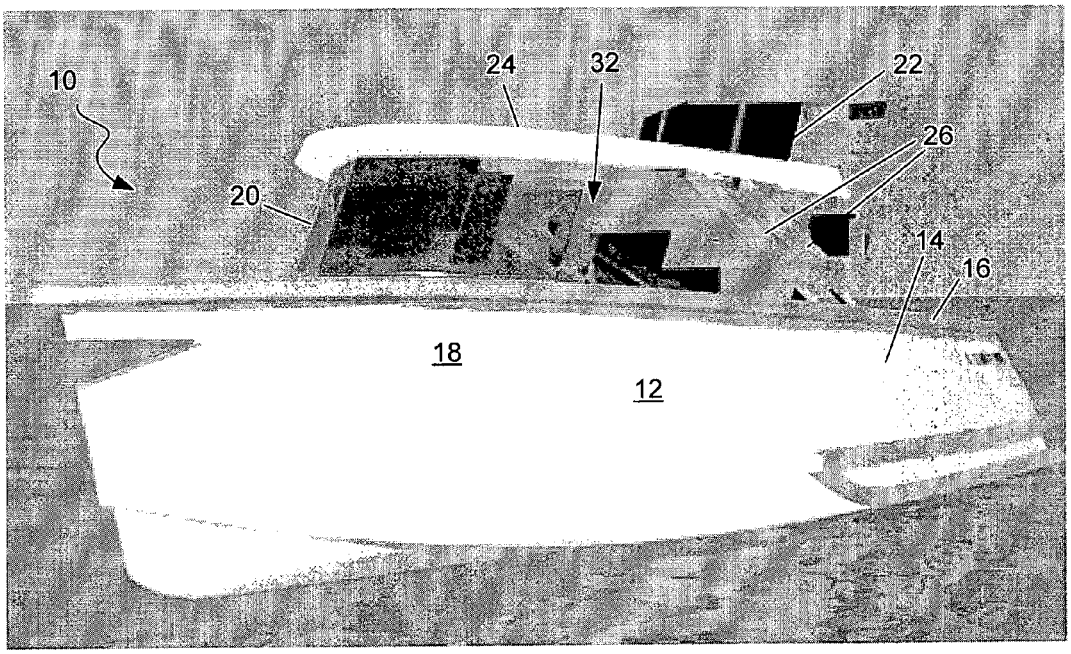

FIGS. 2 and 5 illustrate the covered areas of the boat 10 in a second configuration, for example a "limousine" configuration, in which the windscreen 20 is extended above the gunwales 16 and the hard top 24 is partially erected to overlap the extended windscreen 20 so that together the windscreen 20 and hard top 24 form an enclosure 32, for example a cabin, over, above and around the front and sides of the foredeck 18. In this configuration the windscreen 20 and the hard top 24 form a secure, climate-controlled and sealable cabin 32 over, above and around seating in the foredeck 18 to protect passengers seated therein from wind and spray during high speed transit or inclement weather. In addition, the hard top 24 provides an uncovered sunning platform above the cabin 32.

Figure 3:
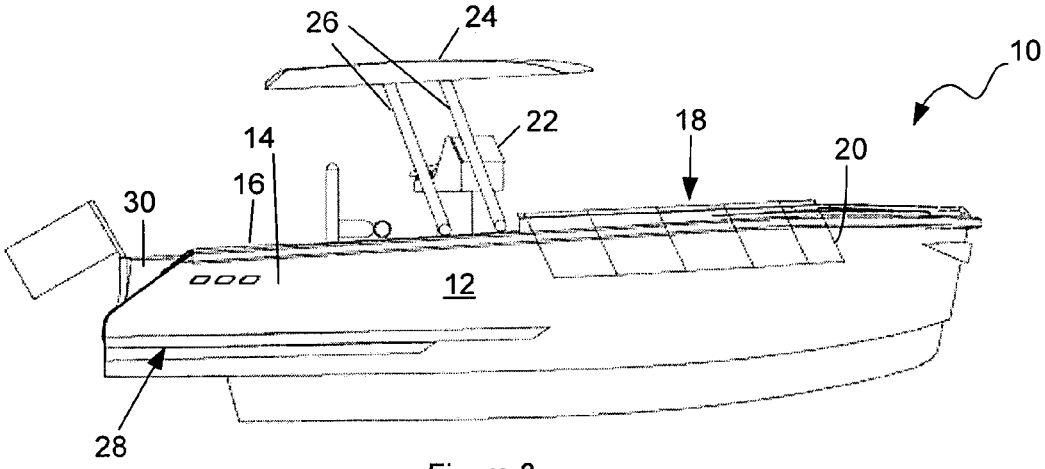
Figure 6:
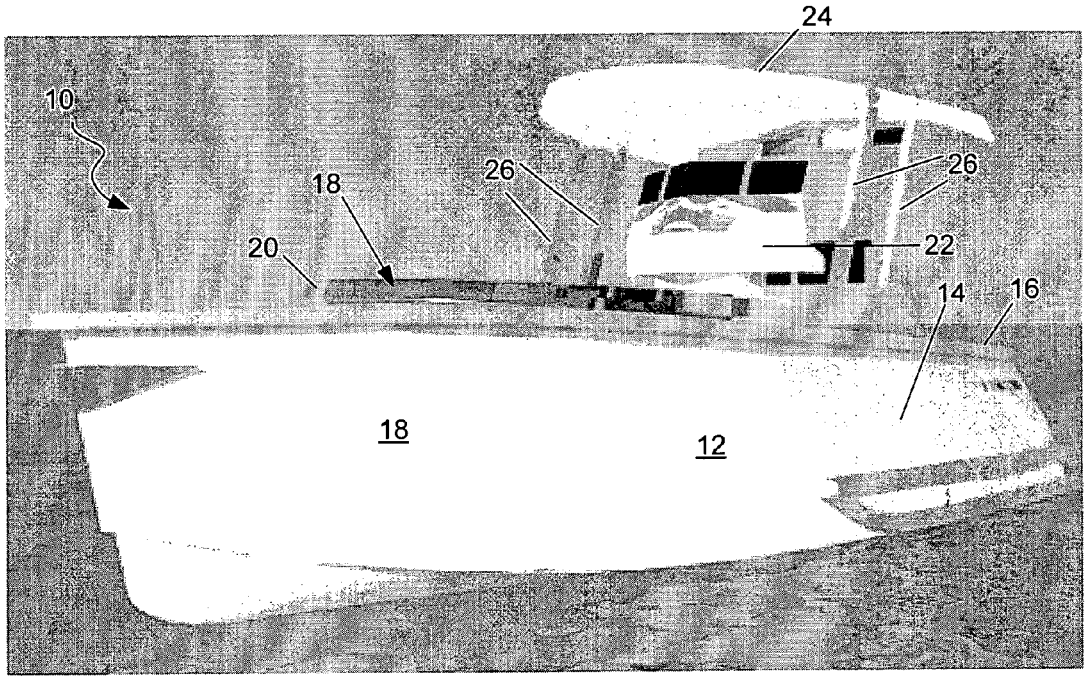

FIGS. 3 and 6 illustrate the covered areas of the boat 10 in a third configuration, for example a "sport" configuration, in which the windscreen 20 is retracted below or just above the gunwales 16, and the hard top 24 is fully erected over and above the helm console 22. In this configuration the hard top 24 is raised completely overhead to form a sports-fisher style canopy providing shade over the helm console 22 and a rearward fishing/diving work area, as well as leaving an uncovered sunning area on the foredeck 18.

Figure 7:
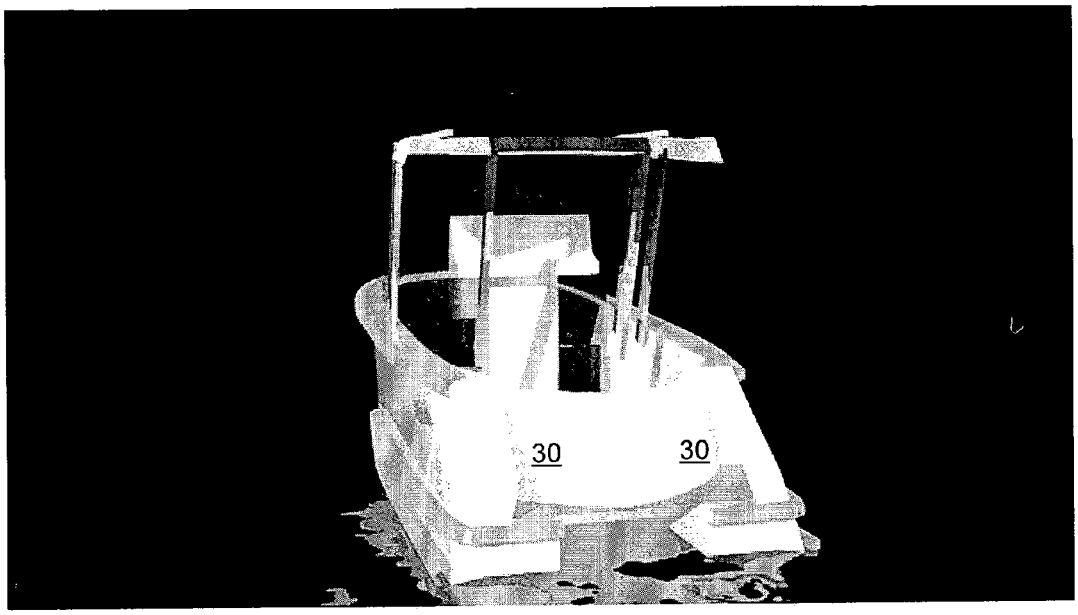
FIGS. 7 and 8 are perspective rear views of the convertible boat with two different stern configurations.
Figure 8:
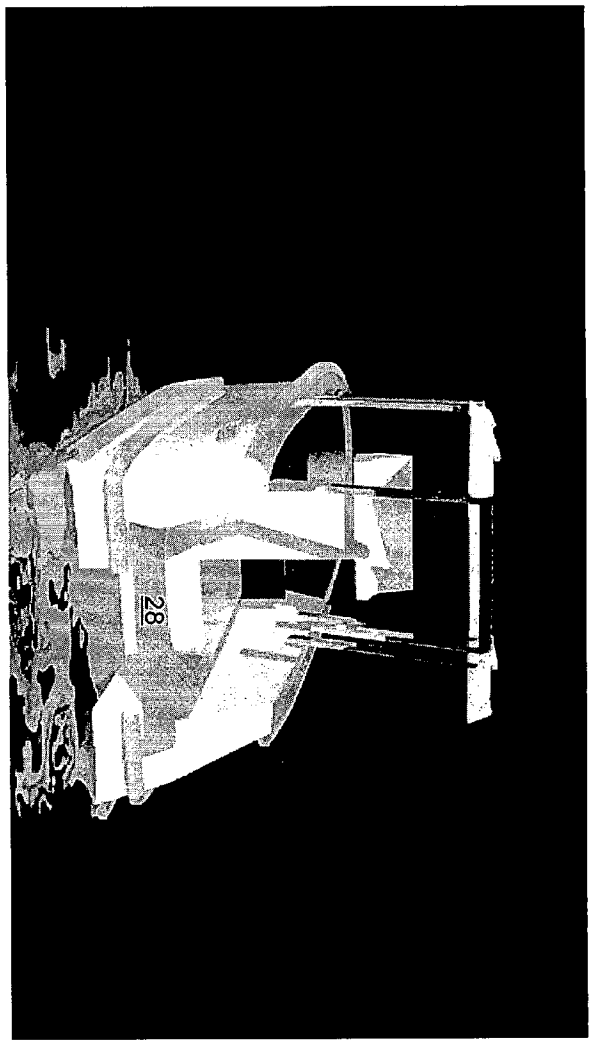

FIG. 7 illustrates the boat 10 in the "sport" configuration with the stern doors 30 matingly extended to rearwardly enclose the aft deck 28 to form, for example, a secure area for fishing. FIG. 8 illustrates the boat 10 in the "sport" configuration with the stern doors 30 retracted inwardly along the side walls 14 to rearwardly open the aft deck 28 to form, for example, a full width swim platform for swimming and diving. As noted above, other stern configurations may also be used.

Embodiments of the boat 10 can be selectively implemented, for example, with:

- deep V hull designs with reverse chines for a smooth dry ride in all weather conditions;
- hulls manufactured from aluminum plate to give light weight and strong design suitable for lifting without the risk of damaging the gel coat such as in glass reinforce plastic hulls;
- in-hull sound insulation for a quiet ride;
- hulls fitted out using composite technology, and finished using quality decking and upholstery;
- common rail diesel engines giving high torque and power outputs with good fuel efficiency providing the ability to refuel from super yacht fuel stores;
- bow thrusters for increased maneuverability;
- choice of stern drive or jet drive propulsion;
- manual or automatic trim tabs used to ensure the vessel can be trimmed for best performance;
- electric anchoring system, allowing remote drop of the anchor by the pilot for beach landings;
- large aft deck space for equipment;
- large stowage compartments;
- chart plotters with electronic maps;
- radar;
- electronic interface between engine diagnostics and radar/chart screen;
- depth sounder interface with radar screen;
- UHF/VHF radio;
- underwater lights;
- floor lights; and
- a sound system.

Although not shown, the hard top 24 of the invention may alternatively be implemented and supplied, for example as an aftermarket accessory, separately from the boat 10 without the windscreen 20. When supplied without the windscreen 20, the hard top 24 is pivotally attachable to respective side walls 14 of the boat 10 via dual hinged arms 26 so that in use the hard top 24 is selectively erectable and collapsible between:

- a first configuration in which the hard top 24 is collapsed forwardly to overlap the gunwales 16 to form a platform covering the foredeck 18;
- a second configuration in which the hard top 24 is partially erected to form a cover over and above the foredeck 18; and
- a third configuration in which the hard top 24 is fully erected over and above the helm console 22.

Embodiments of the invention provide versatile, convertible boats having covered areas that can be flexibly and repeatedly reconfigured for use as a comfortable limousine, as well as a functional water sports vessel and a work boat. The hard top convertible roof allows the boat to be selectively converted between a sports mode, a limousine mode and a work mode. As such, embodiments of the invention provide a so-called "Sports Utility Vessel" (SUV) which is versatile, yet provides the quality and aesthetics expected of luxury boats, for example, yacht tenders. The SUV is a multi-purpose utility vessel that combines the ability to work, rest and play. It is designed to incorporate the speed and agility required for water sports, has aft deck space to be used for sports fishing and diving, and has the comfort and ride required for use as a limousine.

The embodiments have been described by way of example only and modifications are possible within the scope of the claims which follow.

The invention claimed is:

1. A boat having opposing side walls with gunwales thereon, a foredeck between the side walls and below the gunwales, an extensible and retractable windscreen in front and around the sides of the foredeck, a helm console behind the foredeck, and an erectable and collapsible hard top pivoted to the side walls of the boat, wherein the boat is selectively convertible between:

- a first configuration in which the windscreen is retracted below or just above the gunwales, and the hard top is collapsed forwardly to overlap the retracted windscreen and/or the gunwales to form a platform covering the foredeck;
- a second configuration in which the windscreen is extended above the gunwales, and the hard top is partially erected to overlap the extended windscreen, so that together the windscreen and hard top form an enclosure over, above and around the front and sides of the foredeck; and a third configuration in which the windscreen is retracted below or just above the gunwales, and the hard top is fully erected over and above the helm console.

2. A boat according to claim 1, wherein the hard top is pivoted to each side wall by one or two dual hinged arms.

3. A boat according to claim 1, wherein the windscreen is slidably mounted to each side wall on linear tracks.

4. A boat according to claim 1, wherein the hard top and windscreen are each controllably actuatable between selected positions by one or more actuators.

5. A boat according to claim 1, wherein the foredeck includes a seating area.

6. A boat according to claim 1, wherein the helm console is a center console.

7. A hard top for a boat having opposing side walls with gunwales thereon, a foredeck between the side walls and below the gunwales, an extensible and retractable windscreen in front and around the sides of the foredeck, and a helm console behind the foredeck, wherein the hard top is pivotally attachable to respective side walls of the boat via dual hinged arms so that the hard top is selectively erectable and collapsible between:

a first configuration in which the hard top is collapsed forwardly to overlap the gunwales to form a platform covering the foredeck;

a second configuration in which the hard top is partially erected to form, in combination with the windscreen a cover over and above the foredeck; and a third configuration in which the hard top is fully erected over and above the helm console.

8. A boat according to claim 2, wherein the windscreen is slidably mounted to each side wall on linear tracks.

9. A boat according to claim 2, wherein the hard top and windscreen are each controllably actuatable between selected positions by one or more actuators.

10. A boat according to claim 3, wherein the hard top and windscreen are each controllably actuatable between selected positions by one or more actuators.

11. A boat according to claim 2, wherein the foredeck includes a seating area.

12. A boat according to claim 3, wherein the foredeck includes a seating area.

13. A boat according to claim 4, wherein the foredeck includes a seating area.

14. A boat according to claim 2, wherein the helm console is a center console.

15. A boat according to claim 3, wherein the helm console is a center console.

16. A boat according to claim 4, wherein the helm console is a center console.

17. A boat according to claim 5, wherein the helm console is a center console.

* * * * *